US008712306B2

(12) United States Patent
Maeda

(10) Patent No.: US 8,712,306 B2
(45) Date of Patent: Apr. 29, 2014

(54) OPTICAL FIXING DEVICE AND IMAGE FORMING APPARATUS

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 191 days.

(21) Appl. No.: 13/272,899

(22) Filed: Oct. 13, 2011

(65) Prior Publication Data

US 2012/0093553 A1 Apr. 19, 2012

(30) Foreign Application Priority Data

Oct. 14, 2010 (JP) ..... 2010-232025

(51) Int. Cl.
*G03G 15/20* (2006.01)

(52) U.S. Cl.
USPC ..... 399/336

(58) Field of Classification Search
USPC ..... 399/336, 335, 320
See application file for complete search history.

(56) References Cited

U.S. PATENT DOCUMENTS

| | | | | |
|---|---|---|---|---|
| 5,459,561 | A * | 10/1995 | Ingram | 399/336 |
| 2009/0245896 | A1 | 10/2009 | Ishikake et al. | |
| 2010/0254738 | A1* | 10/2010 | Kagawa | |
| 2011/0058869 | A1* | 3/2011 | Kagawa | 399/336 |
| 2011/0116851 | A1* | 5/2011 | Tanaka et al. | 399/336 |
| 2011/0222935 | A1* | 9/2011 | Egusa et al. | 399/336 |
| 2011/0236821 | A1* | 9/2011 | Kageyama | 399/336 |

FOREIGN PATENT DOCUMENTS

| | | | |
|---|---|---|---|
| CN | 101859075 | A | 10/2010 |
| JP | 7-168469 | A | 7/1995 |
| JP | 7-191560 | A | 7/1995 |
| JP | 11-038802 | A | 2/1999 |
| JP | 2006-3694 | A | 1/2006 |
| JP | 2009-251021 | A | 10/2009 |
| JP | 2010-210649 | A | 9/2010 |

* cited by examiner

*Primary Examiner* — Susan Lee
(74) *Attorney, Agent, or Firm* — Birch, Stewart, Kolasch & Birch, LLP

(57) ABSTRACT

An optical fixing device is provided that is capable of improving fixability as well as improving smoothness of an image on a recording medium that is formed after fixing, and forming a high-quality image of high gloss level. An optical fixing device includes a recording sheet fixing conveyance section that conveys a recording sheet on which a toner image is formed; a laser irradiation section that irradiates with light the toner image formed on the recording sheet that is conveyed by the recording sheet fixing conveyance section; and a pressurizing section that is disposed on a downstream side in a conveyance direction of the recording sheet from the light irradiation section and pressurizes the toner image on the recording sheet after irradiation of light by the light irradiation section.

6 Claims, 5 Drawing Sheets

OPTICAL FIXING DEVICE AND IMAGE FORMING APPARATUS

CROSS-REFERENCE TO RELATED APPLICATION

This application claims priority to Japanese Patent Application No. 2010-232025, which was filed on Oct. 14, 2010, the contents of which are incorporated herein by reference in its entirety.

BACKGROUND OF THE TECHNOLOGY

1. Field of the Technology

The present technology relates to an optical fixing device and an image forming apparatus.

2. Description of the Related Art

An electrophotographic image forming apparatus such as a copier, a printer or a facsimile is provided with a fixing device for heating, melting and fixing an unfixed toner image formed on a recording medium such as a recording sheet. As an example of the fixing device, Japanese Unexamined Patent Publication JP-A 11-38802 (1999) discloses a roller-pair type fixing device comprising a fixing roller and a pressure roller.

The fixing roller is a roller member having an elastic layer formed on the surface of a hollow metal core made of metal such as aluminum, and a heat source such as a halogen lamp is arranged inside the metal core. The temperature on the surface of the fixing roller is controlled by a temperature control device which turns on/off the halogen lamp, and temperature control is performed based on a signal that is outputted from a temperature sensor disposed on the surface of the fixing roller. The pressure roller is a roller member having a heat-resistant elastic layer such as silicone rubber disposed on the surface of the metal core. Such a pressure roller is in pressure-contact with a peripheral face of the fixing roller, and a nip region is formed between the fixing roller and the pressure roller due to elastic deformation of the heat-resistant elastic layer.

In such a fixing device, a recording medium on which an unfixed toner image is formed is held in the nip region between the fixing roller and the pressure roller, and both these rollers are rotated, thereby conveying the recording medium, as well as melting and fixing the toner image on the recording medium by heat of the peripheral face of the fixing roller.

In the roller-pair type fixing device, however, the fixing roller and the pressure roller at room temperature are needed to be increased to a predetermined temperature after supplying power, and thus required to have a warm-up period. Moreover, in a standby state where image formation is not performed, the surface of the roller is needed to be kept at the predetermined temperature, and thus must be heated all the time even at the standby period. As a result, there is a problem such that unnecessary energy is consumed at times other than image formation.

In order to solve such a problem, Japanese Unexamined Patent Publication JP-A 7-191560 (1995) discloses a laser fixing device for condensing laser beams emitted from a plurality of laser devices on a recording medium, thereby fixing an unfixed toner image. In such a laser fixing device, the laser beams emitted from the plurality of laser devices are condensed on the recording medium, and the laser beams with increased light intensity are irradiated to an unfixed toner image on the recording medium, thus making it possible to improve fixability.

However, in the laser fixing device disclosed in JP-A 7-191560, the unfixed toner image on the recording medium is fixed only with heat caused by irradiation of a laser beam, and an image on the recording medium formed after fixing has thus no sufficiently high fix level as well as no sufficiently high smoothness and a gloss level.

SUMMARY OF THE TECHNOLOGY

Therefore, an object of the technology is to provide an optical fixing device and an image forming apparatus that are capable of improving fixability as well as improving smoothness of an image on a recording medium that is formed after fixing, and forming a high-quality image of high gloss level.

The technology provides an optical fixing device comprising:

a recording medium conveyance section that conveys a recording medium on which a toner image is formed;

a light irradiation section that irradiates with light the toner image formed on the recording medium that is conveyed by the recording medium conveyance section; and a pressurizing section that is disposed on a downstream side in a conveyance direction of the recording medium from the light irradiation section with respect to the conveyance direction of the recording medium that is conveyed by the recording medium conveyance section, and pressurizes the toner image on the recording medium after irradiation of light by the light irradiation section.

The optical fixing device includes a recording medium conveyance section that conveys a recording medium on which a toner image is formed; a light irradiation section that irradiates with light the toner image formed on the recording medium that is conveyed by the recording medium conveyance section; and a pressurizing section that is disposed on a downstream side in a conveyance direction of the recording medium from the light irradiation section, and pressurizes the toner image on the recording medium after irradiation of light by the light irradiation section. In the optical fixing device of the technology, a toner image formed on a recording medium is irradiated with light and heated by the light irradiation section, and also pressurized by the pressurizing section. Therefore, the optical fixing device is capable of improving a fix level of an image on a recording medium formed after fixing, while capable of improving smoothness of the image and forming a high-quality image of high gloss level.

Further, it is preferable that the light irradiation section and the pressurizing section are disposed in pressure-contact with each other so that heat generated from the light irradiation section is moved to the pressurizing section.

The light irradiation section and the pressurizing section are disposed in pressure-contact with each other so that heat generated from the light irradiation section is moved to the pressurizing section. Thereby, heat generated when the light irradiation section irradiates a toner image formed on a recording medium with light is transferred to the pressurizing section. Therefore, when the pressurizing section pressurizes the toner image on the recording medium after irradiation of light, heat transferred from the light irradiation section is also imparted. Namely, the toner image formed on the recording medium is irradiated with light and heated by the light irradiation section, and also heated and pressurized by the pressurizing section. Accordingly, the optical fixing device is capable of improving a fix level of an image on a recording medium formed after fixing, while capable of improving smoothness of the image and forming a high-quality image of high gloss level.

Additionally, in order to cool heat generated at the time of irradiation of light by the light irradiation section, a cooling section such as a fan is generally needed, and electricity that is supplied for the cooling section is also needed separately. Accordingly, as described above, by configuring so that heat which is dissipated from the light irradiation section is transferred to the pressurizing section and the transferred heat is used to fix a toner image on a recording medium, it is possible to improve fixability of the toner image on the recording medium, as well as to reduce electricity needed for cooling without a need to provide the cooling section for cooling the irradiation section.

Further, it is preferable that the pressurizing section comprises an endless pressure belt that is supported around a plurality of supporting rollers with tension so as to be rotatable, and the light irradiation section is disposed in pressure-contact with the pressure belt.

According to the technology, the pressurizing section comprises an endless pressure belt that is supported around a plurality of supporting rollers with tension so as to be rotatable, and the light irradiation section is disposed in pressure-contact with the pressure belt. The pressurizing section on a receiving side of heat generated from the light irradiation section is configured to be an endless pressure belt, so that it is possible to enlarge a heat receiving area, thus making it possible to improve a heat transfer efficiency toward the pressurizing section from the light irradiation section.

Further, it is preferable that the optical fixing device comprises a pressing roller that faces the light irradiation section with the pressure belt interposed therebetween and is disposed so as to be rotatable, and presses the pressure belt against the light irradiation section.

The optical fixing device further comprises a pressing roller that is disposed inside the pressure belt so as to be rotatable. The pressing roller is disposed facing the light irradiation section with the pressure belt interposed therebetween, and presses the pressure belt against the light irradiation section. This makes it possible to enhance adhesiveness of the pressure belt and the light irradiation section, so that it is possible to improve a heat transfer efficiency toward the pressure belt from the light irradiation section.

Further, it is preferable that the optical fixing device comprises a plate-like pressing member that is disposed facing the light irradiation section with the pressure belt interposed therebetween, and presses the pressure belt against the light irradiation section.

The optical fixing device further comprises a plate-like pressing member that is disposed inside the pressure belt. The pressing member is disposed facing the light irradiation section with the pressure belt interposed therebetween, and presses the pressure belt against the light irradiation section. This makes it possible to enhance adhesiveness of the pressure belt and the light irradiation section, so that it is possible to improve a heat transfer efficiency toward the pressure belt from the light irradiation section.

Further, it is preferable that the light irradiation section is composed of a semiconductor laser element array in which a plurality of semiconductor laser elements are arranged in an array in a direction perpendicular to the conveyance direction of the recording medium.

The optical irradiation section is composed of a semiconductor laser element array in which a plurality of semiconductor laser elements are arranged in an array in a direction perpendicular to the conveyance direction of the recording medium. For example, in the case of irradiating an entire surface of a recording medium with light by one light source, it is needed to scan with light in a width direction of the recording medium. Therefore, it takes time for a fixing process, thus having a limitation in fixing at high speed. Furthermore, scanning with light causes the device to be complicated and have cost increases.

Whereas, the light irradiation section is configured to be a semiconductor laser element array, so that it is not needed to scan with a laser beam in a width direction of a recording medium, thus making it possible to fix at high speed with a simple device configuration. Moreover, rather than high output with one light source, high output in a configuration in which a plurality of semiconductor laser elements are provided makes an area of a heat radiation section in which heat of the light irradiation section is emitted larger. Therefore, the light irradiation section is configured to be a semiconductor laser element array, so that it is possible to enlarge a contact area with the pressure section, thus making it possible to improve a heat transfer efficiency to the pressure section from the light irradiation section.

Moreover, the technology provides an image forming apparatus comprising the optical fixing device mentioned above.

Since the image forming apparatus is provided with the optical fixing device, it is possible to improve a fix level of an image on a recording medium that is formed after fixing, while to improve smoothness of the image so as to form a high-quality image of high gloss level.

BRIEF DESCRIPTION OF THE DRAWINGS

Other and further objects, features, and advantages will be more explicit from the following detailed description taken with reference to the drawings wherein.

DETAILED DESCRIPTION

Figure 1:
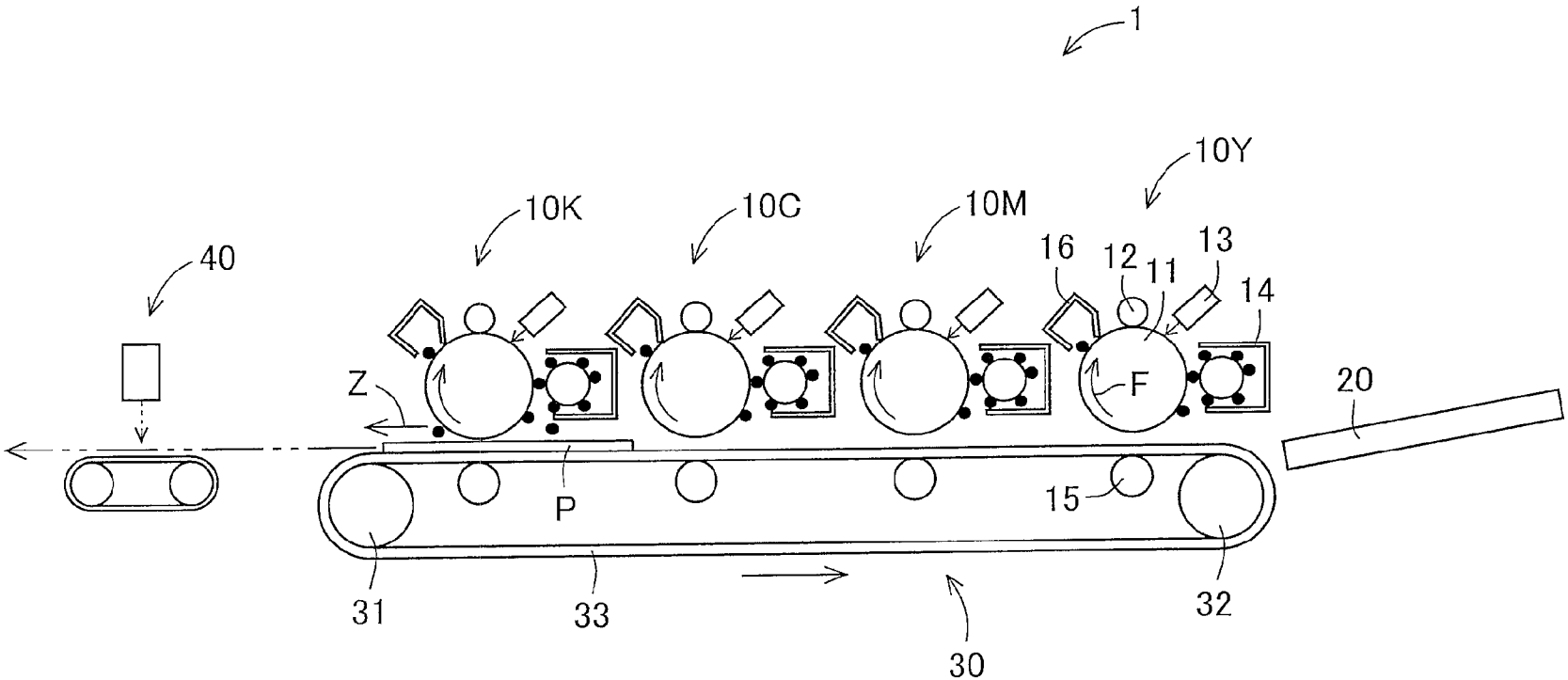
FIG. 1 is a diagram showing a configuration of an image forming apparatus according to an embodiment.

Now referring to the drawings, preferred embodiments are described below.

FIG. 1 is a diagram showing a configuration of an image forming apparatus 1 according to an embodiment. The image forming apparatus 1 is, for example, an electrophotographic color image forming apparatus, and for example, based on image data that is transmitted from each terminal device which is connected via a network or image data that is read by a scanner, forms a color or monochrome image on a recording sheet P as a recording medium.

The image forming apparatus 1 is provided with four visible image formation units 10Y, 10M, 10C and 10K (hereinafter, collectively described as a "visible image formation unit 10" in some cases), a supply tray 20, a recording sheet conveyance section 30 and an optical fixing device 40. The optical fixing device 40 provided in the image forming apparatus 1 is an optical fixing device according to an embodiment, which details will be described below.

The image forming apparatus 1 has four visible image formation units 10Y, 10M, 10C and 10K that are arranged side by side, corresponding to each color of yellow (Y), magenta (M), cyan (C) and black (K). The visible image formation unit 10Y performs image formation with use of a toner of yellow (Y), the visible image formation unit 10M performs image formation with use of a toner of magenta (M), the visible image formation unit 10C performs image formation with use of a toner of cyan (C) and the visible image formation unit 10K performs image formation with use of a toner of black (K). As specific arrangement, a so-called tandem system is provided that four sets of the visible image formation unit 10 are disposed along a conveyance path of the recording sheet P which connects the supply tray 20 of the recording sheet P and the optical fixing device 40.

Each of the visible image formation unit 10 has a substantially same configuration, only having a difference of colors of toners for handling, and includes a charging roller 12, an exposure section 13, a developing device 14, a transfer roller 15 and a cleaner unit 16 around a photoreceptor drum 11. Note that, the developing devices 14 of the visible image formation units 10Y, 10M, 10C and 10K have toners of yellow (Y), magenta (M), cyan (C) and black (K) that are contained therein, respectively.

The photoreceptor drum 11 in a drum shape is rotationally driven by a driving section (not shown) in an arrow F direction around an axis thereof, and bears a toner image. The charging roller 12 evenly charges the surface of the photoreceptor drum 11 to a predetermined potential. The exposure section 13 exposes the surface of the photoreceptor drum 11 that is charged by the charging roller 12, and forms an electrostatic latent image on the surface of the photoreceptor drum 11 according to image data inputted to the image forming apparatus 1. The developing device 14 visualizes the electrostatic latent image formed on the surface of the photoreceptor drum 11 with toners of respective colors, and forms a toner image on the surface of the photoreceptor drum 11.

Among toners used for image formation, color toners (yellow, magenta and cyan) have low optical absorptance compared to a black toner, and thus secures the same absorptance as that of the black toner by adding an infrared absorption agent. As the infrared absorption agent, for example, phthalocyanine, polymethine, cyanine, onium, a nickel complex and the like are useable. These infrared absorption agents may be used in combination. An additive amount of the infrared absorption agent is preferably 1 part by weight or more and 5 parts by weight or less based on 100 parts by weight of a binder resin of the color toner. The above-described toners are used for developers such as a nonmagnetic one-component developer, a nonmagnetic two-component developer and a magnetic developer.

The transfer roller 15 is applied with bias voltage having polarity opposite to that of a toner, and causes a toner image formed on the surface of the photoreceptor drum 11 to be transferred onto the recording sheet P that is conveyed by the recording sheet conveyance section 30 which is described below. The cleaner unit 16 removes and collects a toner remained on the surface of the photoreceptor drum 11 after developing process with the developing device 14 and transfer of the toner image formed on the photoreceptor drum 11. Transfer of a toner image with respect to the recording sheet P as described above is performed once for each of four colors.

The visible image formation unit 10 forms a toner image on the recording sheet P as described below. Namely, the surface of the photoreceptor drum 11 is evenly charged with the charging roller 12, thereafter exposing the surface of the photoreceptor drum 11 by the exposure section 13 according to input image data to form an electrostatic latent image. The electrostatic latent image on the surface of the photoreceptor drum 11 is then developed by the developing device 14 to visualize the toner image, and the visualized toner image, as the toner image of each color, is sequentially subjected to multilayer transfer to the recording sheet P that is conveyed from the supply tray 20 by the transfer roller 15 applied with bias voltage having polarity opposite to that of the toner.

The supply tray 20 is capable of placing a plurality of the recording sheets P, and separates the plurality of the recording sheets P that are placed in the supply tray 20 sheet by sheet for supplying to the visible image formation unit 10Y on the nearest side of the supply tray 20.

The recording sheet conveyance section 30 includes a driving roller 31, an idling roller 32 and a conveyor belt 33, and conveys the recording sheet P that is supplied from the supply tray 20 in a recording sheet conveyance direction Z so that the toner image which is formed by the visible image formation unit 10 is transferred to the recording sheet P. The driving roller 31 and the idling roller 32 tension the endless conveyor belt 33. The driving roller 31 is controlled by a driving section (not shown) to rotate around an axis thereof so as to rotate the conveyor belt 33 along a conveyance path at predetermined circumferential speed, for example, 220 mm/sec. Note that, the driving roller 31 and the idling roller 32 are arranged parallel to the photoreceptor drum 11. The conveyor belt 33 generates static electricity on the outside surface, and is rotated corresponding to rotary drive of the driving roller 31 to convey the recording sheet P in the recording sheet conveyance direction Z while electrostatically adsorbing the recording sheet P.

The recording sheet P is, after a toner image is transferred onto the surface thereof while being conveyed by the conveyor belt 33, peeled from the conveyor belt 33 at curvature of the driving roller 31 to be conveyed to the optical fixing device 40. The optical fixing device 40 applies appropriate heat to the recording sheet P to melt a toner so as to fix the toner image on the surface of the recording sheet P, thereby forming an image.

Figure 2:
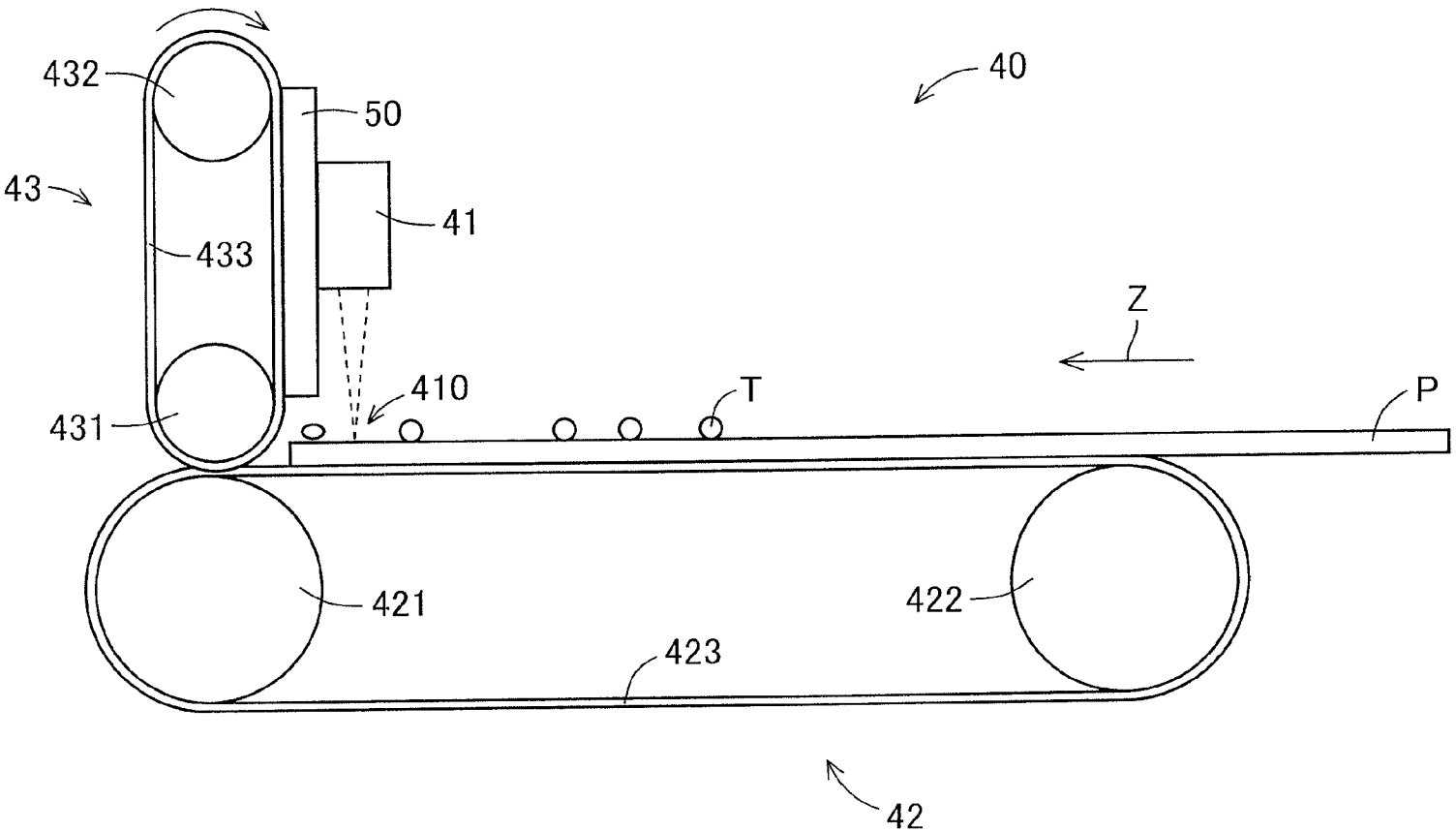
FIG. 2 is a diagram showing a configuration of the optical fixing device according to a first embodiment.

FIG. 2 is a diagram showing a configuration of the optical fixing device 40 according to a first embodiment. The optical fixing device 40 fixes an unfixed toner image T formed on the surface of the recording sheet P to the recording sheet P by heat of a laser beam. The optical fixing device 40 includes a laser irradiation section 41 as a light irradiation section, a recording sheet fixing conveyance section 42 as a recording medium conveyance section and a pressurizing section 43.

The laser irradiation section 41 is a semiconductor laser element array in which a plurality of semiconductor laser elements are arranged in a line in a longitudinal direction, and irradiates the unfixed toner image T with a laser beam. The laser irradiation section 41 will be described in detail below.

The recording sheet fixing conveyance section 42 includes a fixing driving roller 421, a fixing driven roller 422 and a fixing conveyor belt 423, and conveys the recording sheet P on which the unfixed toner image T is formed in the recording sheet conveyance direction Z. The fixing conveyor belt 423 is an endless belt member made of a polyimide resin and the like, and supported around the fixing driving roller 421 and the fixing driven roller 422 that are made of a conductive material, with tension.

The fixing driving roller 421 is rotationally driven around an axis thereof at arbitrary speed by a driving section (not shown), and the fixing conveyor belt 423 is rotated at arbitrary speed by rotation of the fixing driving roller 421. The fixing conveyor belt 423 generates static electricity on the outside surface, and is rotated corresponding to rotary drive of the fixing driving roller 421 while electrostatically adsorbing the recording sheet P so as to convey the recording sheet P in the recording sheet conveyance direction Z. Note that, axes of the fixing driving roller 421 and the fixing driven roller 422 are parallel to axes of the driving roller 31 and the idling roller 32 of the recording sheet conveyance section 30, and the surface placing the recording sheet P on the outside surface of the fixing conveyor belt 423 is flush with the surface placing the recording sheet P on the outside surface of the conveyor belt 33. Furthermore, lengths in an axis direction of the fixing driving roller 421 and the fixing driven roller 422 and a length in a width direction of the fixing conveyor belt 423 are appropriately set corresponding to a size of the recording sheet P. Moreover, at the recording sheet fixing conveyance section 42, among the fixing driving roller 421 and the fixing driven roller 422 for supporting the fixing conveyor belt 423 therearound with tension, the fixing driven roller 422 is a roller on the side close to the conveyor belt 33.

In the optical fixing device 40 of the embodiment, the recording sheet P on which the unfixed toner image T is formed is conveyed to the fixing conveyor belt 423 in contact with the fixing driven roller 422 from the conveyor belt 33. The recording sheet P that electrostatically adsorbs onto the outside surface of the fixing conveyor belt 423 is conveyed at predetermined speed to the laser irradiation section 410 by rotation of the fixing driving roller 421. The unfixed toner image T on the recording sheet P that is conveyed to the laser irradiation section 410 is irradiated with a laser beam according to image information by the laser irradiation section 41, and fixed onto the recording sheet P by heat of the laser beam.

Figure 3B:
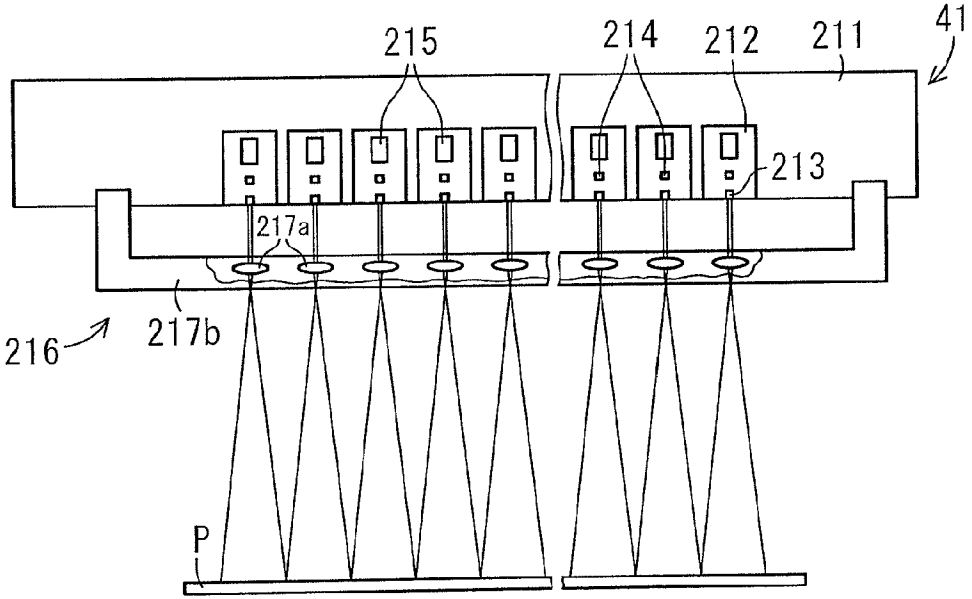
FIG. 3A and FIG. 3B are diagrams showing a configuration of a laser irradiation section.
Figure 3A:
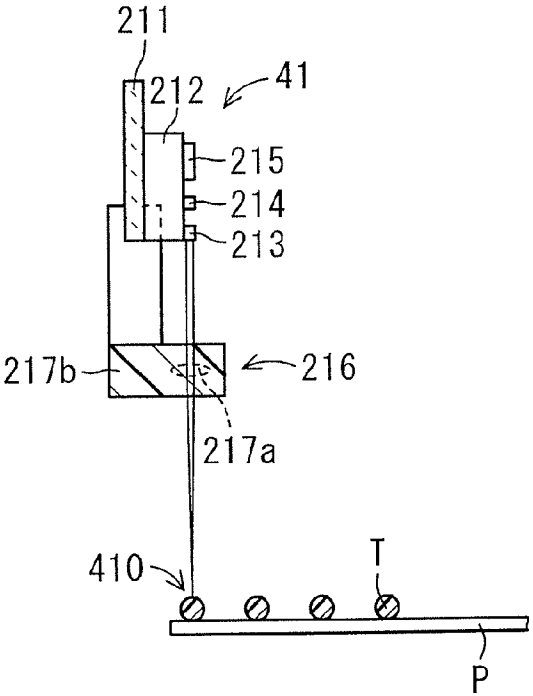

FIGS. 3A and 3B are diagrams showing a configuration of the laser irradiation section 41. FIG. 3A is a sectional view and FIG. 3B is front view.

The laser irradiation section 41 is a device for emitting a laser beam, and in the embodiment, the laser irradiation section 41 is a semiconductor laser element array in which a plurality of semiconductor laser elements 213 are arranged parallel to a width direction of the fixing conveyor belt 423 as well as in a line in a direction perpendicular to the recording sheet conveyance direction Z. A laser beam emitted from the semiconductor laser element 213 has a cross-section in an approximately true circle shape perpendicular to an emission direction that is a direction to which the laser beam moves. Each of the semiconductor laser elements 213 is disposed so that each emission direction of a laser beam to be emitted is all the same, so as to be a direction perpendicular to a direction in which the semiconductor laser elements 213 are arrayed.

As the semiconductor laser element 213, one having a wavelength of a laser beam to be emitted that is 400 nm to 1000 nm is arbitrarily selectable. Each semiconductor laser element 213 is disposed on each silicon substrate 212 that is made of silicon. On the silicon substrate 212, a control circuit (not shown) and a light receiving element 214 are monolithically formed. The light receiving element 214 is a photodiode for monitoring. The control circuit controls voltage that is applied to the semiconductor laser element 213 based on a signal that is inputted from the light receiving element 214 so that output of a laser beam is changed and kept constant. The control circuit and the semiconductor laser element 213 are electrically connected to each other via an electrode and a bonding wire which are not shown.

Additionally, on the silicon substrate 212, a temperature sensor 215 such as a thermistor is disposed in order to measure a temperature of each semiconductor laser element 213. The control circuit controls voltage that is applied to the semiconductor laser element 213 based on temperature data that is detected by the temperature sensor 215.

The silicon substrate 212 is disposed on a ceramic substrate 211 on the surface opposite to the surface on which the semiconductor laser element 213 is disposed. An electrode (not shown) on the ceramic substrate 211 and an electrode (not shown) of the silicon substrate 212 are electrically connected to each other by wire bonding or the like. In the embodiment, the ceramic substrate 211 is a heat dissipation section at the laser irradiation section 41.

Further, in the ceramic substrate 211, a heat sink may be disposed on the surface on the side opposite to the surface on which the silicon substrate 212 is disposed. In the case of providing the heat sink on the ceramic substrate 211, the heat sink serves as a heat dissipation section at the laser irradiation section 41. In the case of providing the heat sink on the ceramic substrate 211, as the heat sink, 10 heat sinks made of an aluminum alloy each of which has a base size of 30 mm long and 30 mm wide, height of 20 mm and heat resistance of 1.6° C./W are arrayed (total heat resistance: 0.16° C./W) to be usable.

The ceramic substrate 211 which serves as a heat dissipation section at the laser irradiation section 41 is preferably coated with a fluorine resin such as PFA, PTFE or FEP that is a material having insulation properties and a low friction coefficient. Thickness in the case of forming a coating layer in the ceramic substrate 211 is, for example, approximately 10 μm. The pressurizing section 43 described below is disposed in contact with the ceramic substrate 211 as the heat dissipation section at the laser irradiation section 41. The ceramic substrate 211 is provided with the coating layer, so that it is possible to secure reduction of friction as well as insulation properties on a contact surface with the pressurizing section 43.

A lens array 216 is disposed on a downstream side in an irradiation direction of the semiconductor laser element 213. The lens array 216 includes the same number of a convex lens 217*a* as a total number of semiconductor laser elements 213, and a lens holder 217*b* for holding the convex lens 217*a*. The lens array 216 is configured so that a laser beam emitted from each of the semiconductor laser elements 213 enters each of the convex lenses 217*a*, respectively.

As described above, the laser irradiation section 41 in the embodiment is a semiconductor laser element array in which a plurality of semiconductor laser elements 213 are arranged parallel to a width direction of the fixing conveyor belt 423 as well as in a line in a direction perpendicular to the recording sheet conveyance direction Z.

For example, in the case of irradiating an entire surface of the recording sheet P with light by one laser beam source, it is needed to scan with a laser beam in a width direction of the recording sheet P. Therefore, it takes time for a fixing process, having a limitation in fixing at high speed. Furthermore, scanning of the laser beam causes the device to be complicated and have cost increases.

Whereas, the light irradiation section 41 is configured to be a semiconductor laser element array, so that it is not needed to scan with a laser beam in a width direction of the recording sheet P, thus making it possible to fix at high speed with a simple device configuration.

Moreover, rather than high output with one laser beam source, high output in a configuration in which a plurality of semiconductor laser elements 213 are disposed makes an area of a heat dissipation section in the light irradiation section 41 larger. Therefore, the light irradiation section 41 is configured to be a semiconductor laser element array so that it is possible to enlarge a contact area with the pressurizing section 43, thus making it possible to improve a heat transfer efficiency to the pressurizing section 43 from the ceramic substrate 211 as the heat dissipation section.

In the optical fixing device 40 of the embodiment, the recording sheet P on which the toner image T that is fixed with heat caused by irradiation of a laser beam is formed is conveyed to the pressurizing section 43 in a state of electrostatic adsorption on the fixing conveyor belt 423.

The pressurizing section 43 is arranged on a downstream side in the recording sheet conveyance direction Z from the laser irradiation section 41, and pressurizes the toner image T on the recording sheet P which is conveyed in a state of electrostatic adsorption on the fixing conveyor belt 423 and is after a laser beam is irradiated by the laser irradiation section 41. In the embodiment, the pressurizing section 43 includes a pressurizing driving roller 431 and a pressurizing driven roller 432 as supporting rollers, and a pressure belt 433.

The pressure belt 433 is an endless belt member including a substrate made of a material having heat resistance such as a polyimide resin and a release layer formed on a surface of the substrate, the release layer being made of a fluorine resin such as PFA or PTFE having release properties with respect to the toner image T. The pressure belt 433 is supported around the pressurizing driving roller 431 and the pressurizing driven roller 432 with tension. In the embodiment, axes of the pressurizing driving roller 431, the pressurizing driven roller 432 and the fixing driving roller 421 that tensions the fixing conveyor belt 423 are parallel to each other, and exist on the same plane. Additionally, the plane including axes of the pressurizing driving roller 431, the pressurizing driven roller 432 and the fixing driving roller 421 is perpendicular to an outer circumferential surface of the fixing conveyor belt 423. Further, lengths in an axis direction of the pressurizing driving roller 431 and the pressurizing driven roller 432 and a length in a width direction of the pressure belt 433 are set to the same length as that of the fixing driving roller 421 in an axis direction.

In the embodiment, the ceramic substrate 211 as a heat dissipation section at the laser irradiation section 41 is in pressure-contact with an outer circumferential surface of the pressure belt 433 with a high thermal conducting member 50 interposed therebetween, so that heat generated from the laser irradiation section 41 moves from the ceramic substrate 211 to the pressure belt 433. Note that, in the case where the laser irradiation section 41 includes a heat sink, the heat sink of the laser irradiation section 41 and the pressure belt 433 may be configured so as to be in pressure-contact with each other with the high thermal conducting member 50 interposed therebetween.

The high thermal conducting member 50 is a plate-like member made of a material having high heat conductivity such as aluminum, silver and copper. In the embodiment, the high thermal conducting member 50 is a rectangular plate-like member comprised of, for example, aluminum. The high thermal conducting member 50 is disposed in surface-contact with the ceramic substrate 211 and the pressure belt 433. The size of the high thermal conducting member 50 is approximately equal to the size between an axis of the pressurizing driving roller 431 and an axis of the pressurizing driven roller 432 in the pressure belt 433.

The high thermal conducting member 50 is held between the ceramic substrate 211 and the pressure belt 433, so that it is possible to transfer heat generated by emission of a laser beam of the semiconductor laser element 213 at a high heat transfer efficiency toward the pressure belt 433 from the ceramic substrate 211.

Further, in the embodiment, the ceramic substrate 211 may be in direct contact with an outer circumferential surface of the pressure belt 433 without using the high thermal conducting member 50. However, in a case where the laser irradiation section 41 is small in size and the ceramic substrate 211 is small, since it is impossible to sufficiently secure a contact area of an outer circumferential surface of the ceramic substrate 211 and an outer circumferential surface of the pressure belt 433, in this case, in order to secure a sufficient heat transfer efficiency from the ceramic substrate 211 to the pressure belt 433, it is preferred that the high thermal conducting member 50 is held between the outer circumferential surface of the ceramic substrate 211 and an outer circumferential surface of the pressure belt 433.

Additionally, high thermal conducting grease or the like may be held between the ceramic substrate 211 and the high thermal conducting member 50. This makes it possible to enhance adhesiveness of the ceramic substrate 211 and the high thermal conducting member 50, so that it is possible to improve a heat transfer efficiency toward the pressure belt 433 from the ceramic substrate 211.

The pressurizing driving roller 431 tensioning the pressure belt 433 is rotationally driven around an axis thereof by a driving section (not shown) at arbitrary speed, and the pressure belt 433 is rotated at arbitrary speed by rotation of the pressurizing driving roller 431. The pressurizing driving roller 431 is disposed in pressure-contact with the fixing driving roller 421 with the pressure belt 433 and the fixing conveyor belt 423 interposed therebetween. The pressurizing driving roller 431 is in pressure-contact with the fixing driving roller 421, so that a pressure-contact section (pressurizing fixing nip region) is formed between the pressure belt 433 and the fixing conveyor belt 423. The recording sheet P on which the toner image T after irradiation of a laser beam is borne is conveyed by the fixing conveyor belt 423 to passes through the pressurizing fixing nip region, so that pressure is imparted to the toner image T on the recording sheet P.

In the optical fixing device 40 of the embodiment, the toner image T borne on the recording sheet P is irradiated with a laser beam and heated by the laser irradiation section 41 so as to be melted and fixed, however, a fix level thereof is low and smoothness thereof is insufficient. In the optical fixing device 40, additionally, pressurization is made by the pressure belt 433 at the pressurizing fixing nip region. Therefore, the optical fixing device 40 is capable of improving a fix level of an image on the recording sheet P formed after fixing, while capable of improving smoothness of the image and forming a high-quality image of high gloss level.

Additionally, in the optical fixing device 40 of the embodiment, as described above, the ceramic substrate 211 is in pressure-contact with the circumferential surface of the pressure belt 433 with the high thermal conducting member 50 interposed therebetween, so that heat transferred to the pressure belt 433 from the ceramic substrate 211 is also imparted to the recording sheet P that passes through the pressurizing fixing nip region. Namely, in the optical fixing device 40 of the embodiment, the toner image T borne on the recording sheet P is irradiated with a laser beam and heated by the laser irradiation section 41, and additionally, heated and pressurized by the pressure belt 433 at the pressurizing fixing nip region. Therefore, the optical fixing device 40 is capable of improving a fix level of an image on the recording sheet P formed after fixing, while capable of improving smoothness of the image and forming a high-quality image of high gloss level.

Further, the pressurizing driving roller 431 may be made of metal alone, however, in the embodiment, is a roller with a rubber layer having flexibility such as urethane rubber or silicone rubber that is formed on the metal core made of aluminum, iron or the like. In this manner, a roller having a rubber layer with flexibility which is formed therein is used as the pressurizing driving roller 431, so that it is possible to enlarge a width of the pressurizing fixing nip region, thus making it possible to further improve fixability.

Further, the pressurizing driving roller 431 has an external diameter which may be the same as an external diameter of the fixing driving roller 421, however, in the embodiment, is set smaller than the external diameter of the fixing driving roller 421. The recording sheet P that passes through the pressurizing fixing nip region between the pressurizing driving roller 431 and the fixing driving roller 421 is peeled from the fixing conveyor belt 423 to be discharged from the optical fixing device 40, and the external diameter of the pressurizing driving roller 431 is set smaller than the external diameter of the fixing driving roller 421, so that it is possible to improve peeling properties of the recording sheet P from the fixing conveyor belt 423.

Here, the semiconductor laser element 213 disposed in the laser irradiation section 41 has a low light energy conversion efficiency (ratio of electricity which is capable of outputting light as a laser beam relative to electricity which is inputted to the semiconductor laser element 213), and the light conversion efficiency is 50% or less. Namely, 50% or more thereof relative to the electricity inputted to the semiconductor laser element 213 is a conversion loss, and such a conversion loss becomes heat that is generated from the laser irradiation section 41 to be dissipated from the ceramic substrate 211. Generally, in order to cool the heat generated from the laser irradiation section 41, the ceramic substrate 211 is cooled down by a cooling section such as a fan or a water circulation unit provided with a water cooling mechanism. In this manner, when the ceramic substrate 211 is cooled down by the cooling section, electricity that is supplied to the cooling section is needed separately so that a total energy conversion efficiency in the laser irradiation section 41 (ratio of electricity used for irradiation of a laser beam relative to total input electricity required for operating the laser irradiation section 41 including electricity inputted to the semiconductor laser element 213 and electricity inputted to the cooling section) is reduced.

Therefore, in the embodiment, as described above, heat dissipated from the ceramic substrate 211 is transferred to the pressure belt 433, and the transferred heat is used to fix the toner image T on the recording sheet P. This makes it possible for the optical fixing device 40 to improve fixability of the toner image T on the recording sheet P as well as reduce electricity required for cooling without a need to include the cooling section for cooling the ceramic substrate 211.

Figure 4:
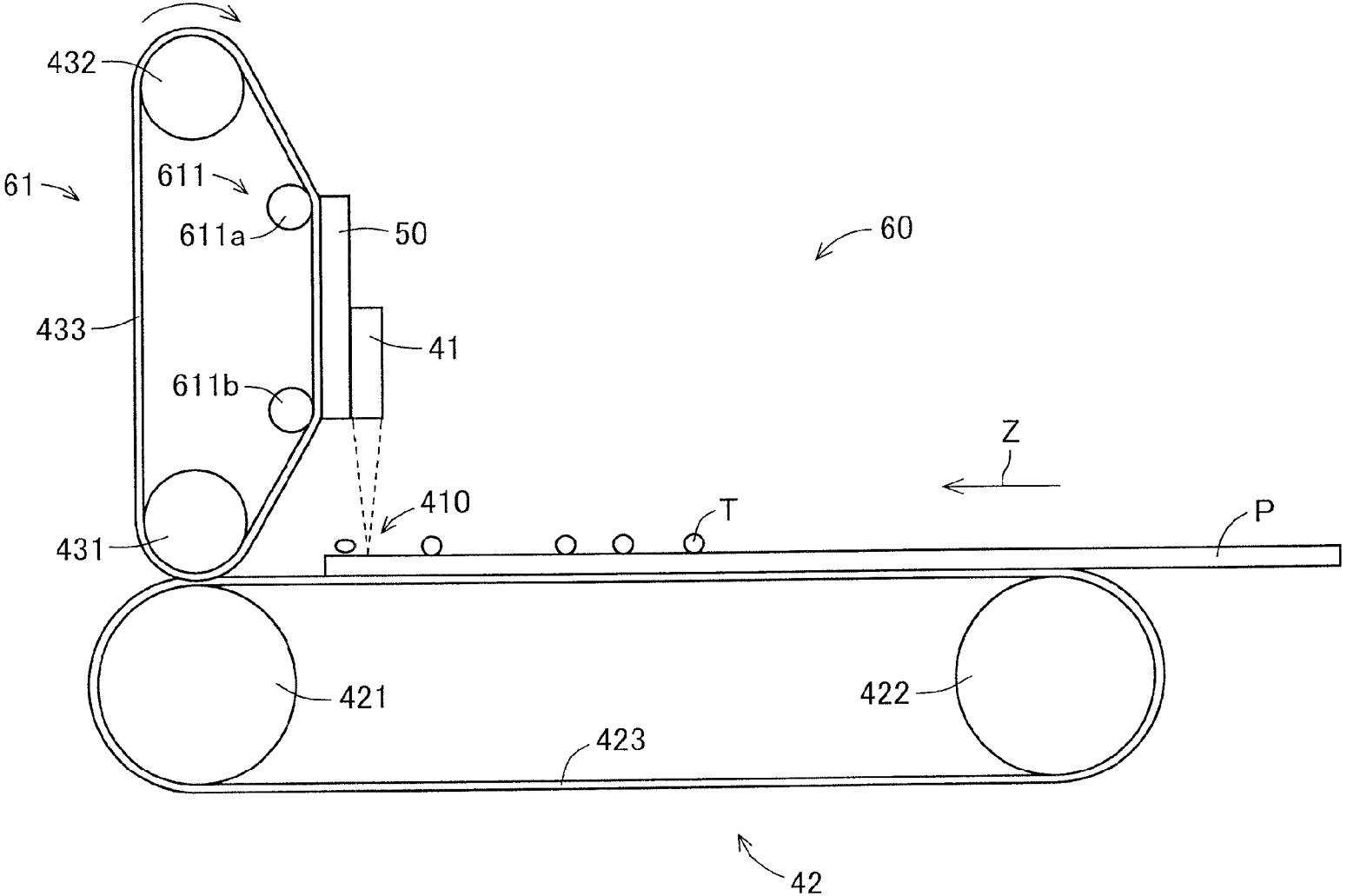
FIG. 4 is a diagram showing a configuration of an optical fixing device according to a second embodiment.

FIG. 4 is a diagram showing a configuration of an optical fixing device 60 according to a second embodiment. The optical fixing device 60 of the embodiment is similar to the above-described optical fixing device 40, and the corresponding parts are denoted by the same reference numerals and description thereof is omitted. The optical fixing device 60 is configured as with the optical fixing device 40 except that a pressurizing section 61 is disposed in place of the above-described pressurizing section 43. The optical fixing device 60 of the embodiment is suitably usable as the above-described optical fixing device of the image forming apparatus 1.

The pressurizing section 61 disposed in the optical fixing device 60 includes at least one pressing roller 611 that is disposed inside the pressure belt 433 that is supported around the pressurizing driving roller 431 and the pressurizing driven roller 432 with tension (on the side opposite to the high thermal conducting member 50 holding the pressure belt 433 therebetween) so as to be rotatable. In the embodiment, the pressurizing section 61 includes two pressing rollers 611*a* and 611*b*.

The pressing rollers 611*a* and 611*b* are provided facing the high thermal conducting member 50 with the pressure belt 433 interposed therebetween, and presses the pressure belt 433 against the high thermal conducting member 50. This makes it possible to enhance adhesiveness of the pressure belt 433 and the high thermal conducting member 50, so that it is possible to improve a heat transfer efficiency via the high thermal conducting member 50 toward the pressure belt 433 from the ceramic substrate 211.

The pressing rollers 611*a* and 611*b* may be made of metal alone, but are preferably rollers with a heat insulating layer having high heat insulating properties such as expandable silicone rubber that is formed on a metal core made of aluminum, iron or the like. The pressing rollers 611*a* and 611*b* have configurations having a heat insulating layer, so that it is possible to prevent heat transferred to the pressure belt 433 via the high thermal conducting member 50 from the ceramic substrate 211 from being transferred to the pressing rollers 611*a* and 611*b*.

Figure 5:
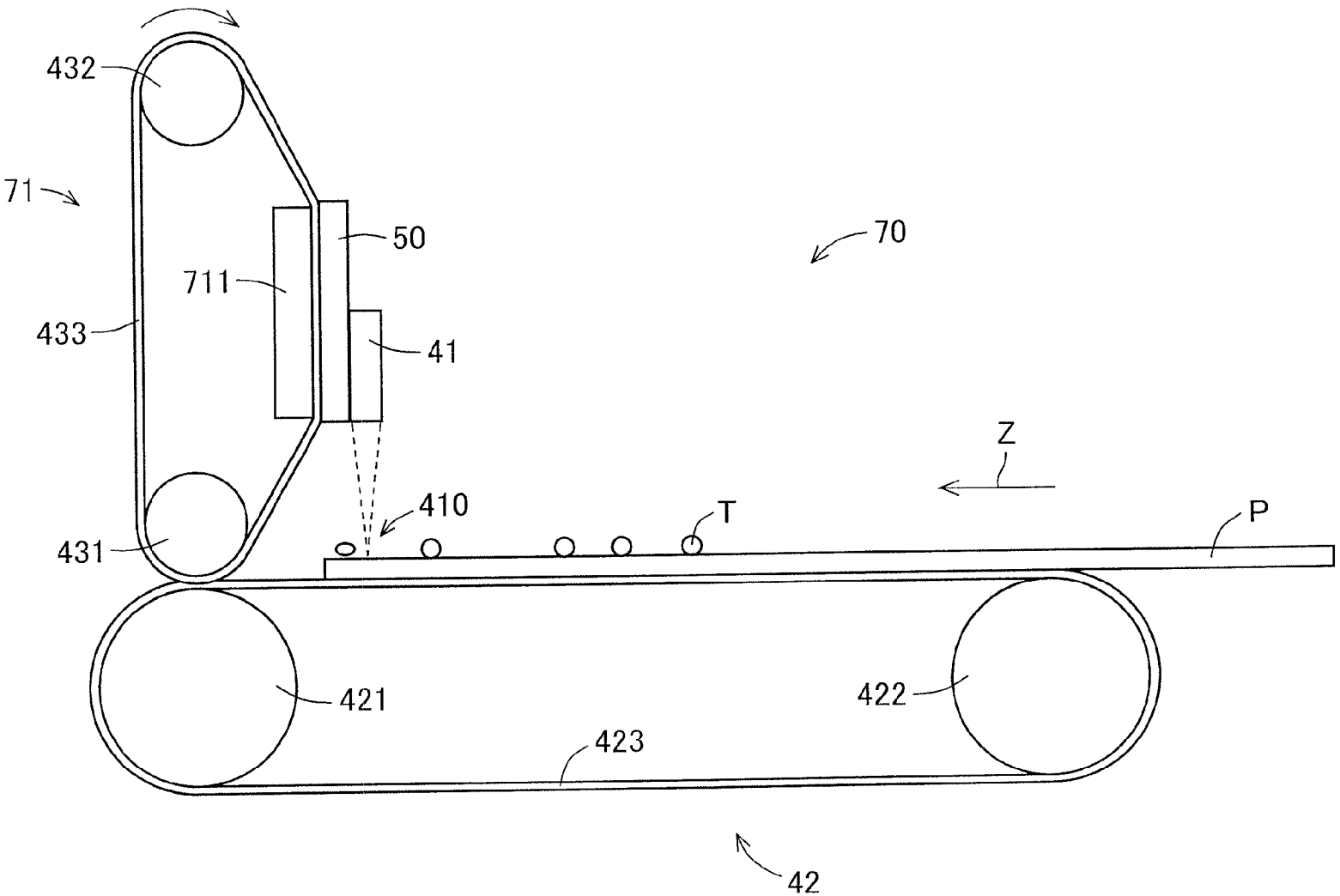
FIG. 5 is a diagram showing a configuration of an optical fixing device according to a third embodiment.

FIG. 5 is a diagram showing a configuration of an optical fixing device 70 according to a third embodiment. The optical fixing device 70 of the embodiment is similar to the above-described optical fixing device 40, and the corresponding parts are denoted by the same reference numerals and description thereof is omitted. The optical fixing device 70 is configured as with the optical fixing device 40 except that a pressurizing section 71 is disposed in place of the above-described pressurizing section 43. The optical fixing device 70 of the embodiment is suitably usable as the above-described optical fixing device of the image forming apparatus 1.

The pressurizing section 71 disposed in the optical fixing device 70 includes a pressing member 711 that is disposed inside the pressure belt 433 that is supported around the pressurizing driving roller 431 and the pressurizing driven roller 432 with tension (on the side opposite to the high thermal conducting member 50 holding the pressure belt 433 therebetween). The pressing member 711 is a rectangular plate-like member, and the size thereof is approximately equal to the size of the high thermal conducting member 50.

The pressing member 711 is disposed facing the high thermal conducting member 50 with the pressure belt 433 interposed therebetween, and presses the pressure belt 433 against the high thermal conducting member 50. This makes it possible to enhance adhesiveness of the pressure belt 433 and the high thermal conducting member 50, so that it is possible to improve a heat transfer efficiency via the high thermal conducting member 50 toward the pressure belt 433 from the ceramic substrate 211.

The pressing member 711 may be made of metal alone, but is preferably a member comprising a substrate made of aluminum, iron or the like and a heat insulating layer having high heat insulating properties such as expandable silicone rubber and an outermost surface layer that is made of a fluorine resin such as PFA or PTFE which is a material having a low friction coefficient, these layers being stacked on the substrate.

The pressing member 711 has a configuration having a heat insulating layer, so that it is possible to prevent heat transferred to the pressure belt 433 via the high thermal conducting member 50 from the ceramic substrate 211 from being transferred to the pressing member 711. Further, the pressing member 711 has a structure having an outermost surface layer made of a material with a low friction coefficient, so that it is possible to suppress abrasion of the pressure belt 433 that rotates in contact with the pressing member 711.

EXAMPLES

Description will be specifically given with examples for the optical fixing device according to the technology.

Example 1

The image forming apparatus comprising the optical fixing device 40 of FIG. 2 was used. Specifically, in Example 1, an image forming apparatus comprising an optical fixing device with a pressurizing section that is disposed on a downstream side in a recording sheet conveyance direction with respect to a laser irradiation section was disposed, and the optical fixing device was configured that a pressure belt of the pressurizing section and a ceramic substrate of the laser irradiation section are disposed in pressure-contact with each other with a high thermal conducting member interposed therebetween.

To the laser irradiation section, 600 W of electricity was inputted to fix an unfixed toner image (toner attachment amount: 0.6 mg/cm$^2$) to a recording sheet at process speed of 220 mm/sec.

Note that, since a light conversion efficiency of the laser irradiation section is 50%, 300 W out of 600 W of electricity inputted to the laser irradiation section was used for irradiation of a laser beam, and the remained 300 W became a conversion loss so that heat was dissipated from the ceramic substrate. The heat dissipated from the ceramic substrate was used for fixing processing by heating and pressurizing in the pressure belt. Namely, in Example 1, a total energy conversion efficiency in the laser irradiation section (ratio of electricity used for irradiation of a laser beam relative to total input electricity required for operating the laser irradiation section) was {(300/600)×100}=50%.

Example 2

A configuration of the optical fixing device disposed in the image forming apparatus was the same as that of Example 1 except being configured that the pressurizing section was not in contact with the laser irradiation section.

To the laser irradiation section, 600 W of electricity was inputted to fix an unfixed toner image (toner attachment amount: 0.6 mg/cm$^2$) to a recording sheet at process speed of 220 mm/sec.

Note that, since a light conversion efficiency of the laser irradiation section is 50%, 300 W out of 600 W of electricity inputted to the laser irradiation section, 300 W thereof was used for irradiation of a laser beam, and the remained 300 W became a conversion loss so that heat was dissipated from the ceramic substrate. A fan was used for cooling heat dissipated from the ceramic substrate, and electricity inputted to the fan was 150 W. Namely, in Example 2, a total energy conversion efficiency in the laser irradiation section (ratio of electricity used for irradiation of a laser beam relative to total input electricity required for operating the laser irradiation section) was {(300/750)×100}=40%.

Comparative Example 1

A configuration of the optical fixing device disposed in the image forming apparatus was the same as that of Example 1 except being configured that the pressurizing section was not provided.

To the laser irradiation section, 600 W of electricity was inputted to fix an unfixed toner image (toner attachment amount: 0.6 mg/cm$^2$) to a recording sheet at process speed of 220 mm/sec.

Note that, since a light conversion efficiency of the laser irradiation section is 50%, 300 W out of 600 W of electricity inputted to the laser irradiation section, 300 W thereof was used for irradiation of a laser beam, and the remained 300 W became a conversion loss so that heat was dissipated from the ceramic substrate. A fan was used for cooling heat dissipated from the ceramic substrate, and electricity inputted to the fan was 150 W. Namely, in Comparative Example 1, a total energy conversion efficiency in the laser irradiation section (ratio of electricity used for irradiation of a laser beam relative to total input electricity required for operating the laser irradiation section) was {(300/750)×100}=40%.

Next, concerning three fixing images formed with the image forming apparatus of Examples 1, 2 and Comparative Example 1, evaluation for a gloss level was performed. The evaluation of the gloss level was measured at an incidence angle and a reflection angle of 75° with use of a gloss meter (VG2000, manufactured by Nippon Denshoku Industries Co., Ltd.). Evaluation results of the gloss level are shown in Table 1.

TABLE 1

| | Gloss level | | | |
|---|---|---|---|---|
| | n = 1 | n = 2 | n = 3 | Average |
| Example 1 | 16 | 14 | 15 | 15 |
| Example 2 | 10 | 8 | 9 | 9 |
| Comparative Example 1 | 5 | 3 | 4 | 4 |

As clarified from the results of Table 1, the gloss levels of Examples 1 and 2 show higher values than that of Comparative Example 1, and it is found that to a toner image formed on a recording sheet, in addition to heat caused by irradiation of a laser beam, pressure due to the pressurizing section is applied, so that it is possible to form a high-quality image.

Further, in the case of comparing Example 1 to Example 2, in Example 1, heat transferred from the ceramic substrate is used at the pressurizing section to fix the toner image formed on the recording sheet, so that a total energy conversion efficiency in the laser irradiation section is favorable. Additionally, in the case of comparing Example 1 to Example 2, an image of higher gloss level is formed in Example 1 compared to Example 2. Accordingly, the heat transferred from the ceramic substrate is used at the pressurizing section to heat and pressurize the toner image formed on the recording sheet, so that it is possible to form a further high-quality image.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. An optical fixing device comprising:

a recording medium conveyance section that conveys a recording medium on which a toner image is formed;

a light irradiation section that irradiates with light the toner image formed on the recording medium that is conveyed by the recording medium conveyance section; and a pressurizing section that is disposed on a downstream side in a conveyance direction of the recording medium from the light irradiation section with respect to the conveyance direction of the recording medium that is conveyed by the recording medium conveyance section, and pressurizes the toner image on the recording medium after irradiation of light by the light irradiation section, wherein the light irradiation section and the pressurizing section are disposed in pressure-contact with each other so that heat generated from the light irradiation section is moved to the pressurizing section.

2. The optical fixing device of claim 1, wherein the pressurizing section comprises an endless pressure belt that is supported around a plurality of supporting rollers with tension so as to be rotatable, and the light irradiation section is disposed in pressure-contact with the pressure belt.

3. The optical fixing device of claim 2, comprising a pressing roller that faces the light irradiation section with the pressure belt interposed therebetween and is disposed so as to be rotatable, and presses the pressure belt against the light irradiation section.

4. The optical fixing device of claim 2, comprising a plate-like pressing member that is disposed facing the light irradiation section with the pressure belt interposed therebetween, and presses the pressure belt against the light irradiation section.

5. The optical fixing device of claim 1, wherein the light irradiation section is composed of a semiconductor laser element array in which a plurality of semiconductor laser elements are arranged in an array in a direction perpendicular to the conveyance direction of the recording medium.

6. An image forming apparatus comprising the optical fixing device of claim 1.

* * * * *